US008857776B2

(12) United States Patent
Chang

(10) Patent No.: US 8,857,776 B2
(45) Date of Patent: Oct. 14, 2014

(54) QUICK-MOUNTING DEVICE FOR CANISTER

(76) Inventor: Hsu-Hui Chang, New Taipei (TW)

( * ) Notice: Subject to any disclaimer, the term of this patent is extended or adjusted under 35 U.S.C. 154(b) by 628 days.

(21) Appl. No.: 13/236,609

(22) Filed: Sep. 19, 2011

(65) Prior Publication Data

US 2013/0068920 A1 Mar. 21, 2013

(51) Int. Cl.

| | |
|---|---|
| ***A47K 1/08*** | (2006.01) |
| ***B65D 83/20*** | (2006.01) |
| ***B65D 83/26*** | (2006.01) |
| ***B05B 11/00*** | (2006.01) |
| ***B05B 15/06*** | (2006.01) |
| *B65D 83/40* | (2006.01) |
| *B65D 83/38* | (2006.01) |
| *B05B 9/08* | (2006.01) |

(52) U.S. Cl.

CPC ..... *B65D 83/262* (2013.01); *B65D 83/205* (2013.01); *B65D 83/40* (2013.01); *B65D 83/388* (2013.01); *B05B 9/0805* (2013.01); *B05B 11/0008* (2013.01); *B05B 15/065* (2013.01); *B05B 15/06* (2013.01)

USPC ..... 248/312; 248/313; 248/316.8

(58) Field of Classification Search

CPC .... B65D 83/205; B65D 82/262; B65D 83/40; B65D 83/388; B05B 9/0805; B05B 11/0008; B05B 15/065; B05B 15/06; A47G 29/18; A47J 47/16; A47L 13/512; A45F 5/02; A45F 5/021

USPC ..... 222/153.1, 182, 645, 402.13; 220/915; 248/311.3, 312, 313, 316.4, 316.6, 248/316.8; 239/302

See application file for complete search history.

(56) References Cited

U.S. PATENT DOCUMENTS

| | | | | |
|---|---|---|---|---|
| 3,661,300 | A * | 5/1972 | Nigro | 222/80 |
| 3,863,814 | A * | 2/1975 | Shelton | 222/153.1 |
| 6,216,925 | B1 * | 4/2001 | Garon | 222/645 |
| 6,840,461 | B1 * | 1/2005 | Burke et al. | 239/337 |
| 8,550,413 | B2 * | 10/2013 | Warrick et al. | 248/229.22 |
| 2002/0017171 | A1 * | 2/2002 | Chang | 81/133 |
| 2010/0323897 | A1 * | 12/2010 | Burke | 504/234 |

FOREIGN PATENT DOCUMENTS

| | | | | |
|---|---|---|---|---|
| GB | 361195 | A * | 11/1931 | A47G 29/18 |

* cited by examiner

*Primary Examiner* — Gwendolyn W Baxter
(74) *Attorney, Agent, or Firm* — Leong C. Lei

(57) ABSTRACT

A quick-mounting device for canisters comprises a housing and a an adjustment. The housing defines a recess at a top thereof and a hollow space therein. The housing is sealed with a cover that defines a though hole at a center thereof. The an adjustment includes two arched pieces and a control piece. The arched pieces are placed in the recess of the housing to define an opening therebetween. The control piece has a pusher and is placed on top of the arched pieces to engage with two ends of each arched piece. Each arched piece is provided with a spring at an external side thereof intermediate of the two ends. Thereby, the pusher of the control piece can be pressed to have the two arched pieces moved outwardly to change the dimension of the opening defined by the two arched pieces so as to mount a canister.

8 Claims, 7 Drawing Sheets

QUICK-MOUNTING DEVICE FOR CANISTER

TECHNICAL FIELD OF THE INVENTION

The present invention relates to a quick-mounting device that can quickly and conveniently mount a canister for spraying a mist of an agent, such as air fresheners, disinfectants, detergents, cosmetics, insect repellents or similar substances.

DESCRIPTION OF THE PRIOR ART

Due to the development of economy and human civilization, the material and spiritual aspects of life are being paid more and more attention. Everyone is actively pursuing the goal of good living environment. To have offices, rooms or cars without special smell or remove the turbidity of the air, they are typically equipped with air-conditioning equipments, air cleaners, etc, to allow persons therein to improve the work efficiency and have better mental state. Alternatively, they can be provided with aromatic agents, electric air fresheners, perfumes so as to eliminate unpleasant odor. Many products for eliminating the air smell are available from the market.

A conventional spray device for aromatic liquid is provided with a hinged clamp that can clamp a neck of a canister. The spray device can be pressed to release a mist of an aromatic agent to allow a room full of good smell to overcome the original odor of the room. When replacing with a canister, the hinged clamp can be opened again to allow the neck of an exhausted canister to be released from the clamp. However, some clamps cannot be opened more than 60 degrees, and thus the user cannot clearly see the coupling status of a canister, so that the replacement is not easy and cannot be accomplished in one operation.

To overcome the drawback of the conventional spray device, the applicant has contrive a quick-mounting device that can quickly and conveniently dismount an exhausted canister and mount a new canister for spraying aromatic agent.

SUMMARY OF THE INVENTION

The primary object of the present invention is to provide a quick-mounting device that can mount a canister quickly and conveniently.

To achieve the above object, the quick-mounting device is implemented to comprise a housing and an adjustment means. The housing defines a recess at a top thereof and a hollow space therein, the recess being defined by a circumferential surface and a bottom surface. The housing is sealed with a cover that defines a though hole at a center thereof. The adjustment means includes two arched pieces and a control piece. The arched pieces are placed in the recess of the housing to define an opening therebetween, wherein the opening communicates with the through hole of the cover and the hollow space of the housing. The control piece has a pusher and is placed on top of the arched pieces to engage with two ends of each arched piece. Each arched piece is provided with a spring at an external side thereof intermediate of the two ends to be elastically engaged with the housing. Thereby, the pusher of the control piece of the adjustment means can be pressed to have the two arched pieces moved outwardly to change the dimension of the opening defined by the two arched pieces so as to mount a canister.

Furthermore, the circumferential surface of the recess of the housing is defined with a first pair of opposing recesses and a second pair of opposing recesses, the first pair of opposing recesses being located at an orientation about 90 degrees relative to the second pair of opposing recesses.

Still furthermore, the control piece is formed into a generally annular piece having two opposing projections, one of which is formed with the pusher, each projection being provided with an engaging protrusion on a bottom surface thereof. Each of the two ends of each arched piece is formed with a sloping surface. Each of the arched pieces is formed with two protrusions and a boss therebetween at an external side intermediate of the two ends for engaging with a corresponding spring.

Still furthermore, each engaging protrusion of the control piece of the adjustment means has two sides formed into a general V-shape for mating with two corresponding slopping surfaces respectively on the two arched pieces Still furthermore, each arched piece of the adjustment means is formed with a sharp edge along an internal side thereof.

Still furthermore, the bottom surface of the recess of the housing is defined with multiple grooves to be inserted with protrusions, which are formed on bottom surfaces of the arched pieces.

Still furthermore, the housing defines a plurality of first holes on a top thereof and the cover defines a plurality of second holes corresponding to the first holes, so that the cover can be sealed with the housing by using fastening members through the first and second holes.

Still furthermore, two opposing lugs are provided on the cover across the through hole of the cover.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
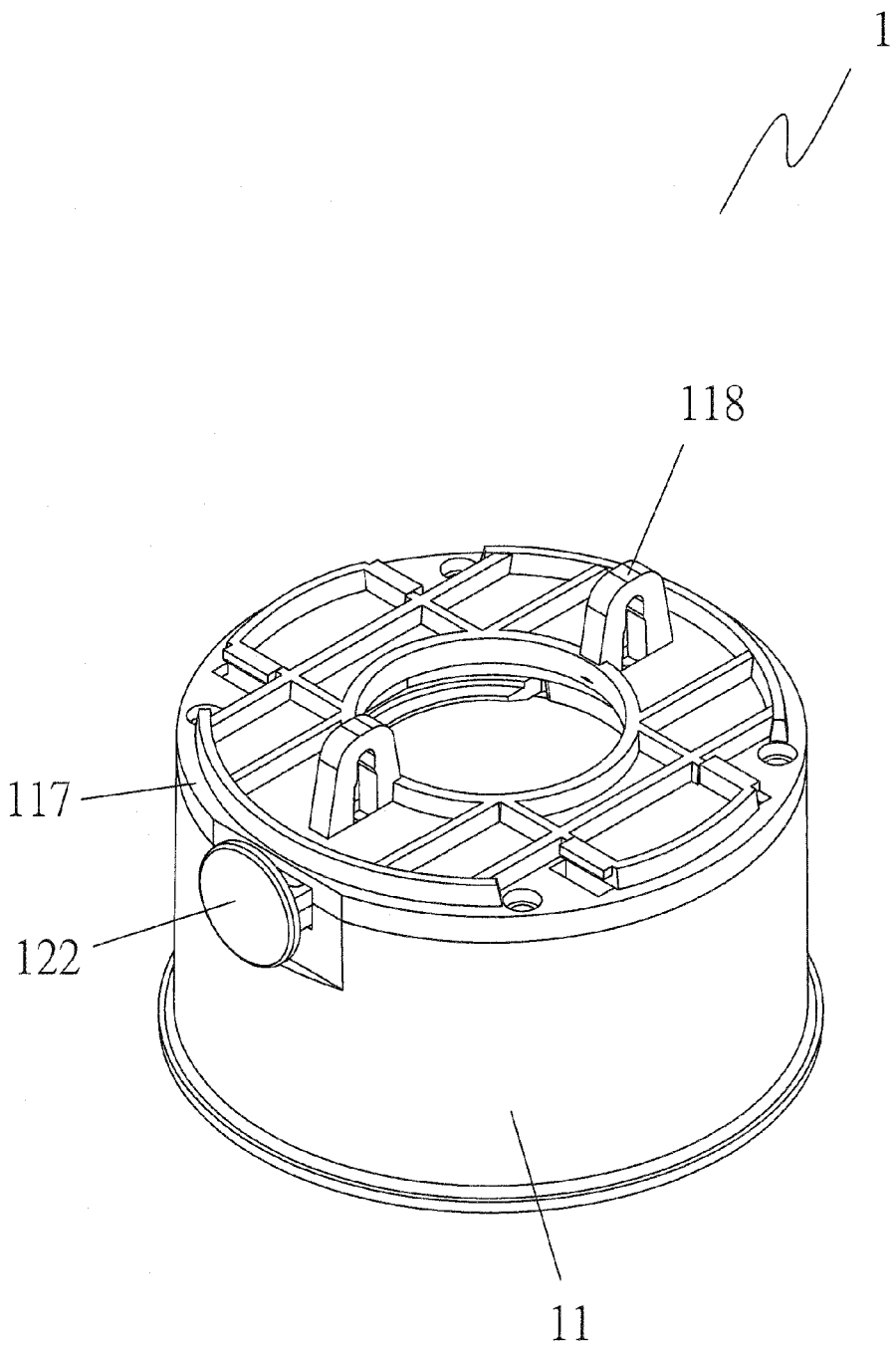
FIG. 1 is a 3-dimensional view of one embodiment according to the present invention.
Figure 2:
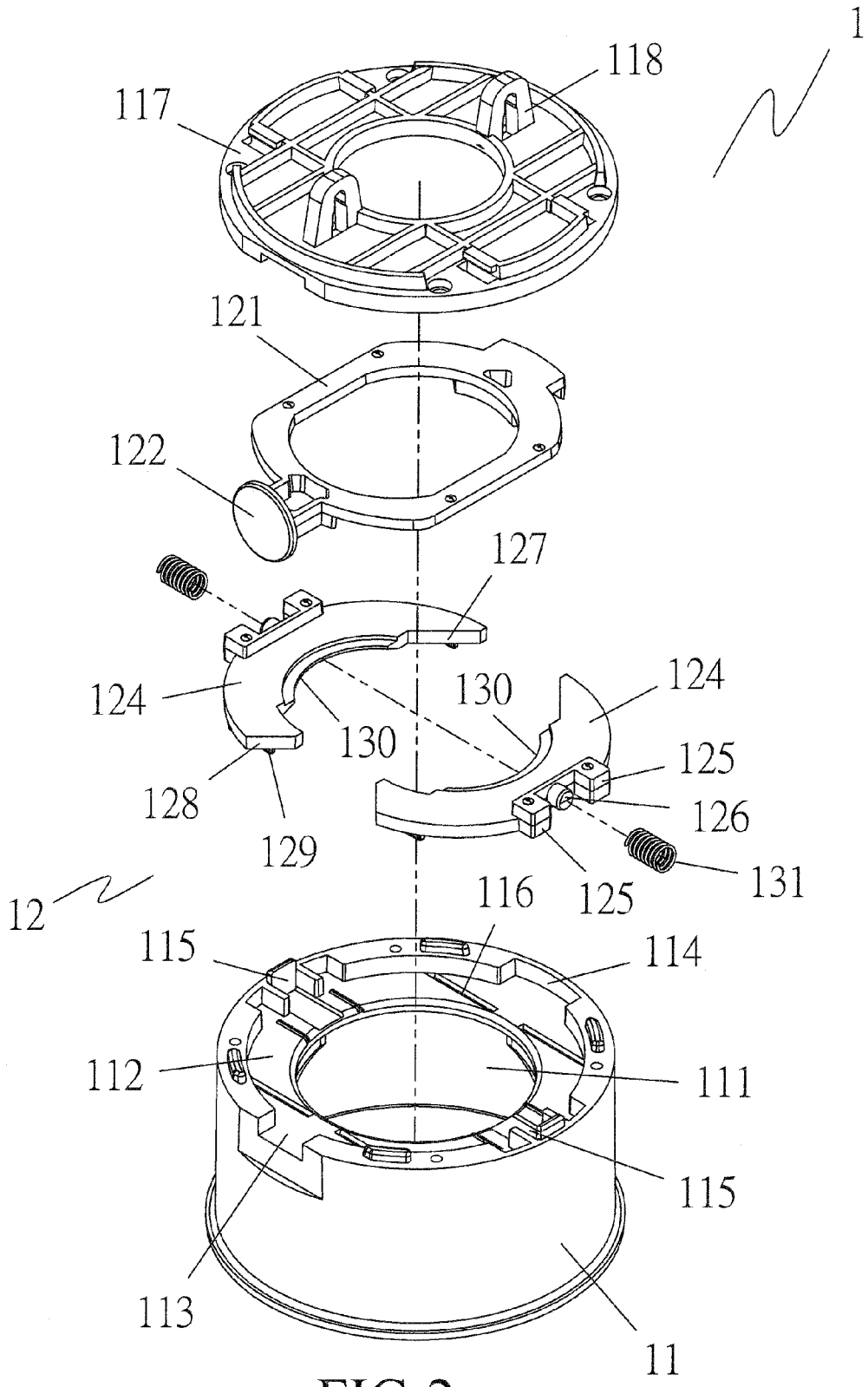
FIG. 2 is an exploded view of the embodiment according to the present invention.

Turning now to FIGS. 1 and 2, one embodiment of a quick-mounting device for canisters according to the present invention is illustrated. The quick mounting device 1 comprises a housing 11 and an adjustment means 12. The housing 11 defines a recess 112 at a top thereof and a hollow space 111 therein, the recess 112 being defined by a circumferential surface and a bottom surface. The circumferential surface of the recess 112 of the housing 11 is defined with a first pair of opposing recesses 113, 114, and a second pair of opposing recesses 115, the first pair of opposing recesses 113, 114 being located at an orientation about 90 degrees relative to the second pair of opposing recesses 115. That is to say, the line formed by the first pair of the opposing recesses 113, 114 is perpendicular to the line formed by the second pair of the opposing recesses 115. Furthermore, the bottom surface of the recess 112 of the housing 11 is defined with multiple grooves 116. The housing 11 is sealed with a cover 117 that defines a though hole at a center thereof. The housing 11 defines a plurality of first holes on a top thereof, and the cover 117 defines a plurality of second holes corresponding to the first holes, so that the cover 117 can be sealed with the housing 11 by using fastening members through the first and second holes. Also, two opposing lugs 118 are provided on the cover 117 across the through hole of the cover 117.

Figure 3:
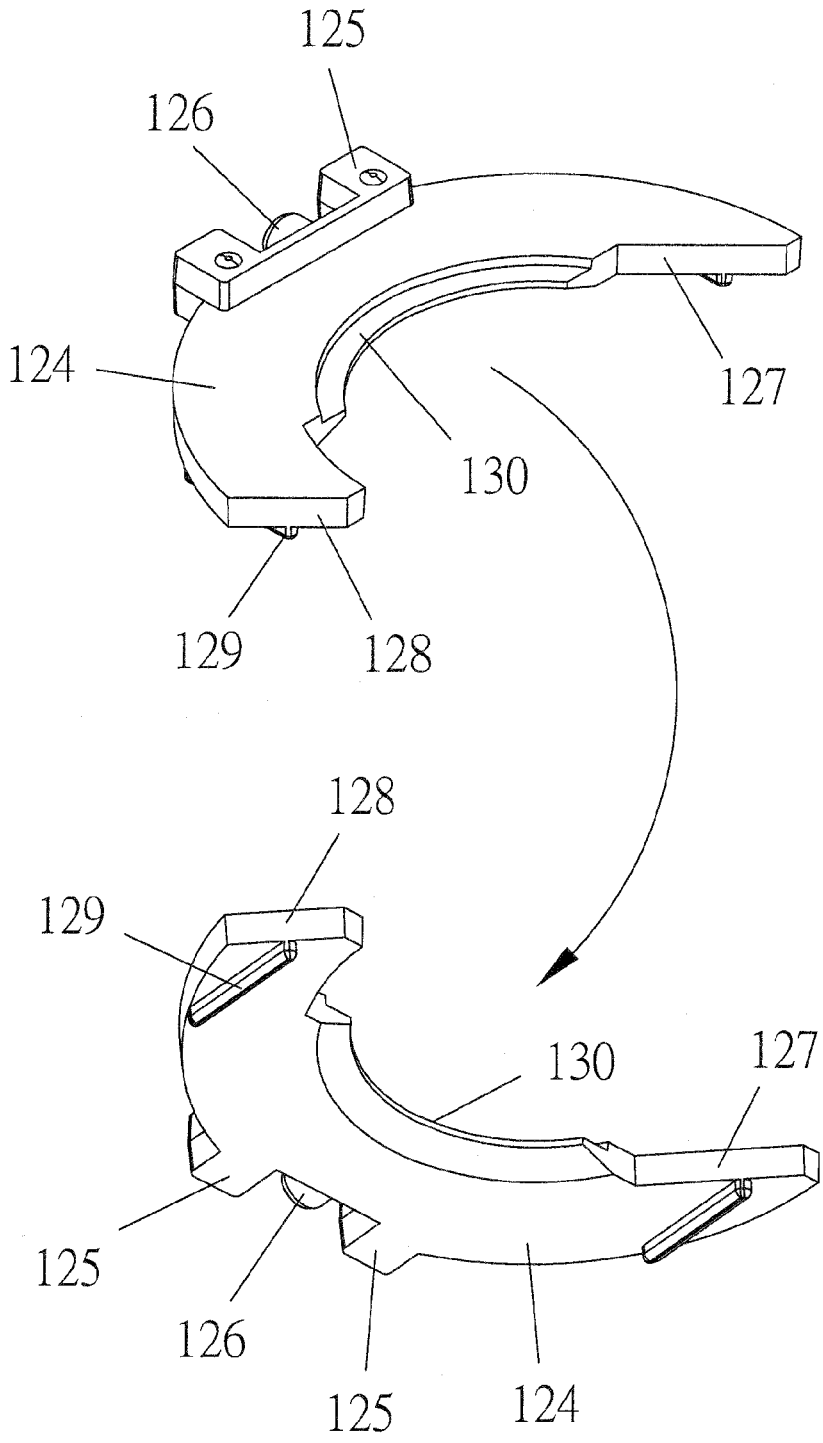
FIG. 3 shows two 3-dimension views of an ached piece of the embodiment respectively seen from different directions.
Figure 4:
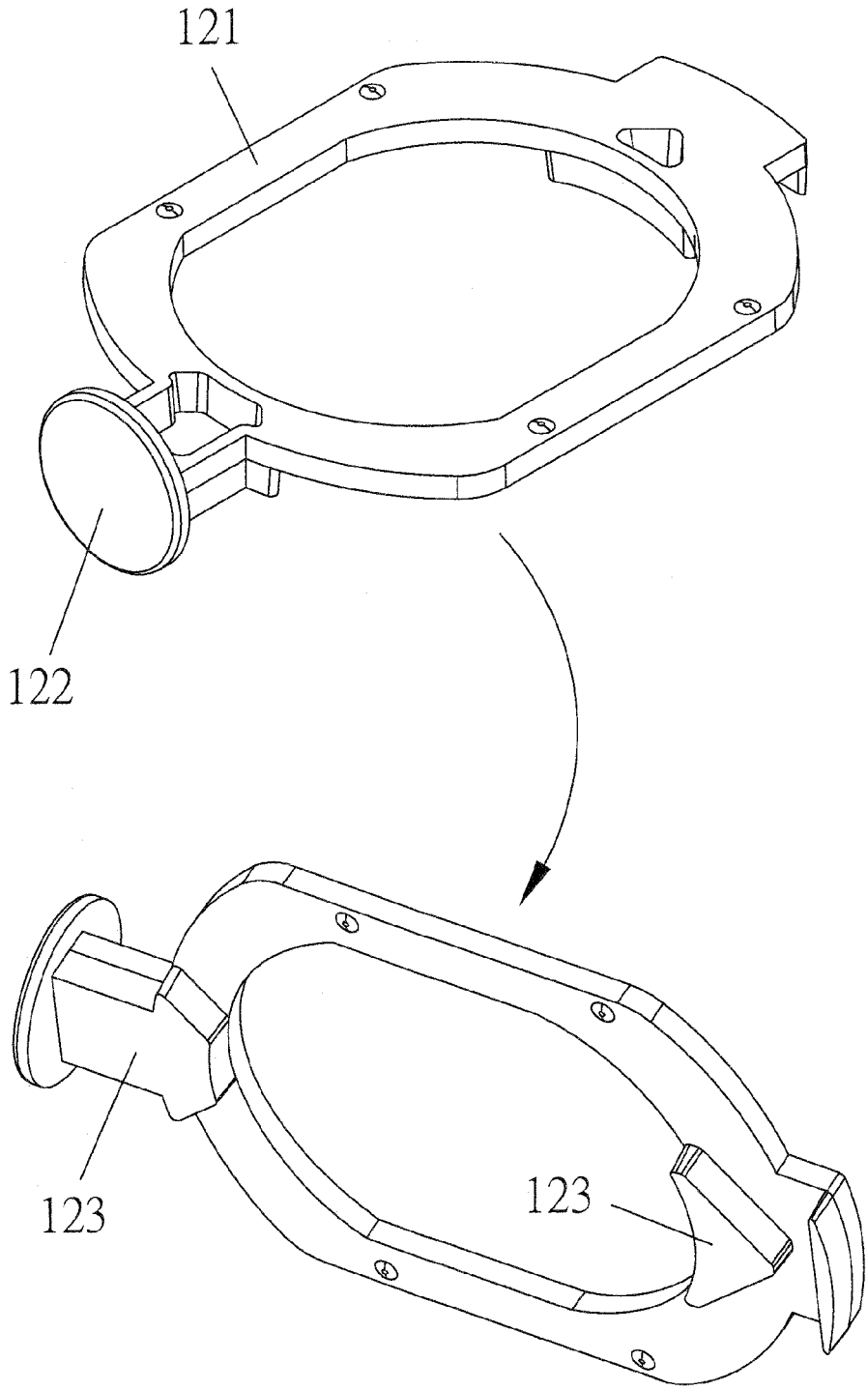
FIG. 4 shows two 3-dimension views of a control piece of the embodiment respectively seen from different directions.

The adjustment means 12 includes two arched pieces 124 and a control piece 121. The arched pieces 124 are placed in the recess 112 of the housing 11 to define an opening therebetween, wherein the opening communicates with the through hole of the cover 117 and the hollow space 111 of the housing 11. The control piece 121 has a pusher 122 and is placed on top of the arched pieces 124 to engage with two ends of each arched piece 124, each arched piece 124 being provided with a spring 131 at an external side thereof intermediate of the two ends to be elastically engaged with the housing 11. As shown in FIGS. 3 and 4, the two ends of each arched piece 124 are respectively formed with sloping surfaces 127, 128. Each of the arched pieces 124 is formed with two protrusions 125 and a boss 126 between the two protrusions 125 at the external side intermediate of the two ends for engaging with a corresponding spring 131. In more detail, the control piece 121 is formed into a generally annular piece having two opposing projections, one of which is formed with the pusher 122, which has a large area. The control piece 121 has a central opening. Each projection is provided with an engaging protrusion 123 at a bottom surface thereof. Each of the engaging portions 123 has two sides formed into a general V-shape for mating with two corresponding slopping surfaces respectively on the two arched pieces 124. Furthermore, each arched piece 124 of the adjustment means 12 is formed with protrusions 129 on a bottom surface thereof to be inserted into the grooves 116 of the housing 11. Each arched piece 124 of the adjustment means 12 is formed with a sharp edge 130 along an internal side thereof.

Figure 5:
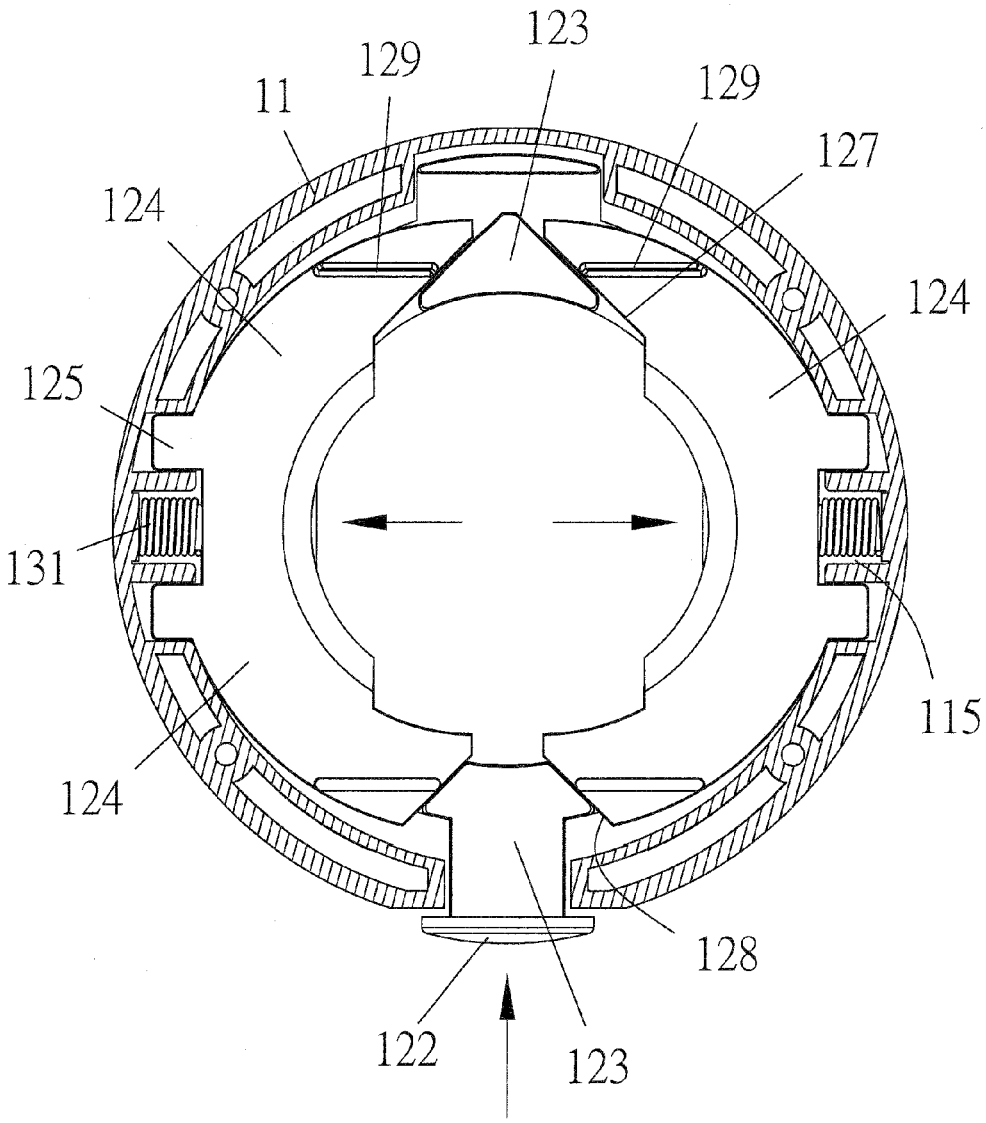
FIG. 5 is a sectional view of the embodiment showing an operational status of the control piece.

As shown, the sharp edges 130 of the arched pieces 124 are located to face to each other; the spring 131 is mounted around the boss 126; the control piece 121 is placed on top of the two arched pieces 124, wherein the sharp edges 130 extend to partly cover the central opening of the control piece 121 (see FIG. 5). Also the protrusions 123 are placed to contact with the sloping surfaces 127, 128 by their two sides formed into a general V-shape. As shown in FIG. 5, the control piece 121 of the adjustment means 12 is placed in the recess 112 of the housing 11, wherein the two projections (one with the pusher 122) are placed in the recesses 113, 114. Furthermore, the protrusions 129 of the two arched pieces 124 are placed in the grooves 116 defined in the bottom surface of the recess 112. The spring 131 and the protrusions 125 are placed in the recesses 115 defined in the circumferential surface of the recess 112 of the housing 11. Thereby, the pusher 122 of the control piece 121 of the adjustment means 12 can be pressed to overcome the compressional force of each spring 131 to have the two arched pieces 124 moved outwardly via the protrusions 123 pushing the sloping surfaces 127, 128 so as to change the dimension of the opening defined by the sharp edges 130 of the two arched pieces 124.

Figure 6:
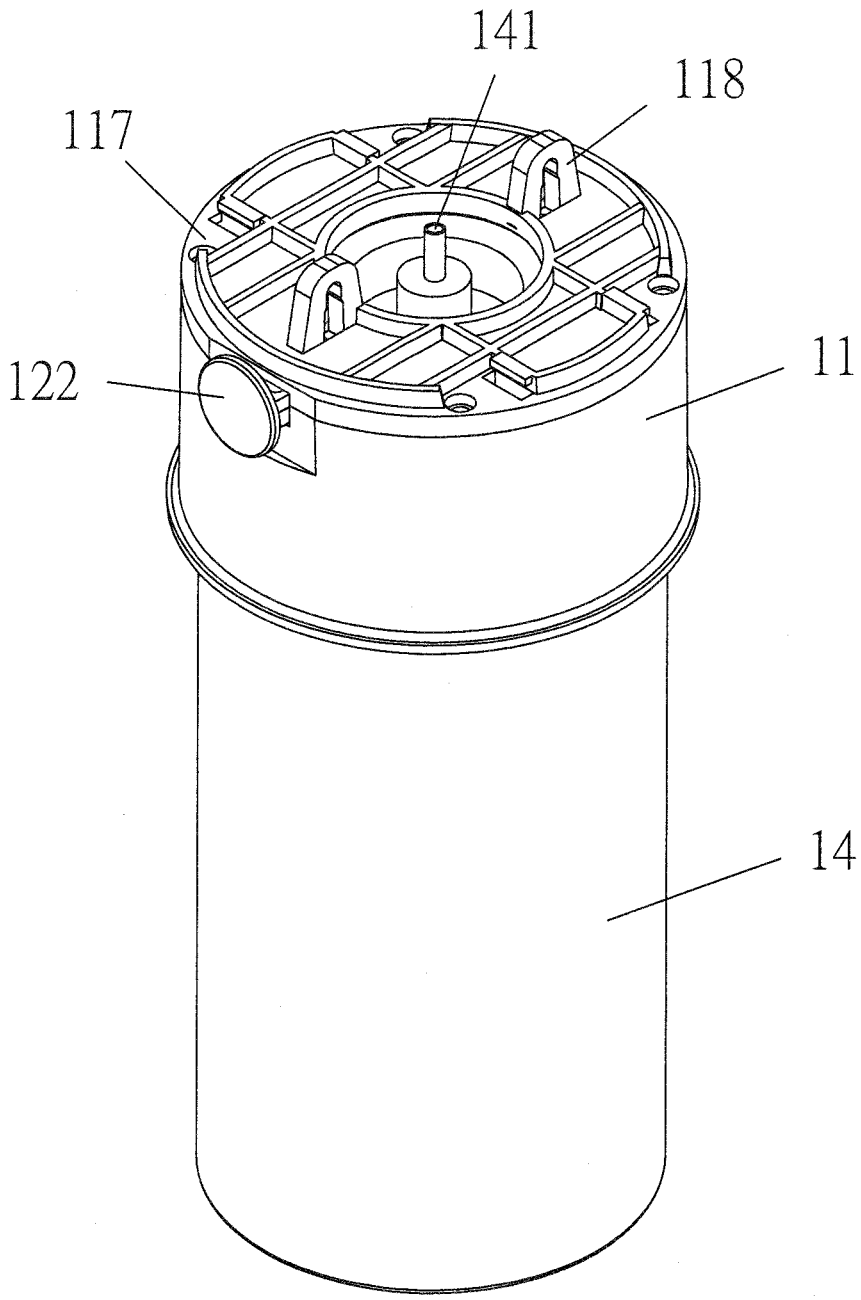
FIG. 6 is a 3-dimensional view of the embodiment, which has mounted a canister.
Figure 7:
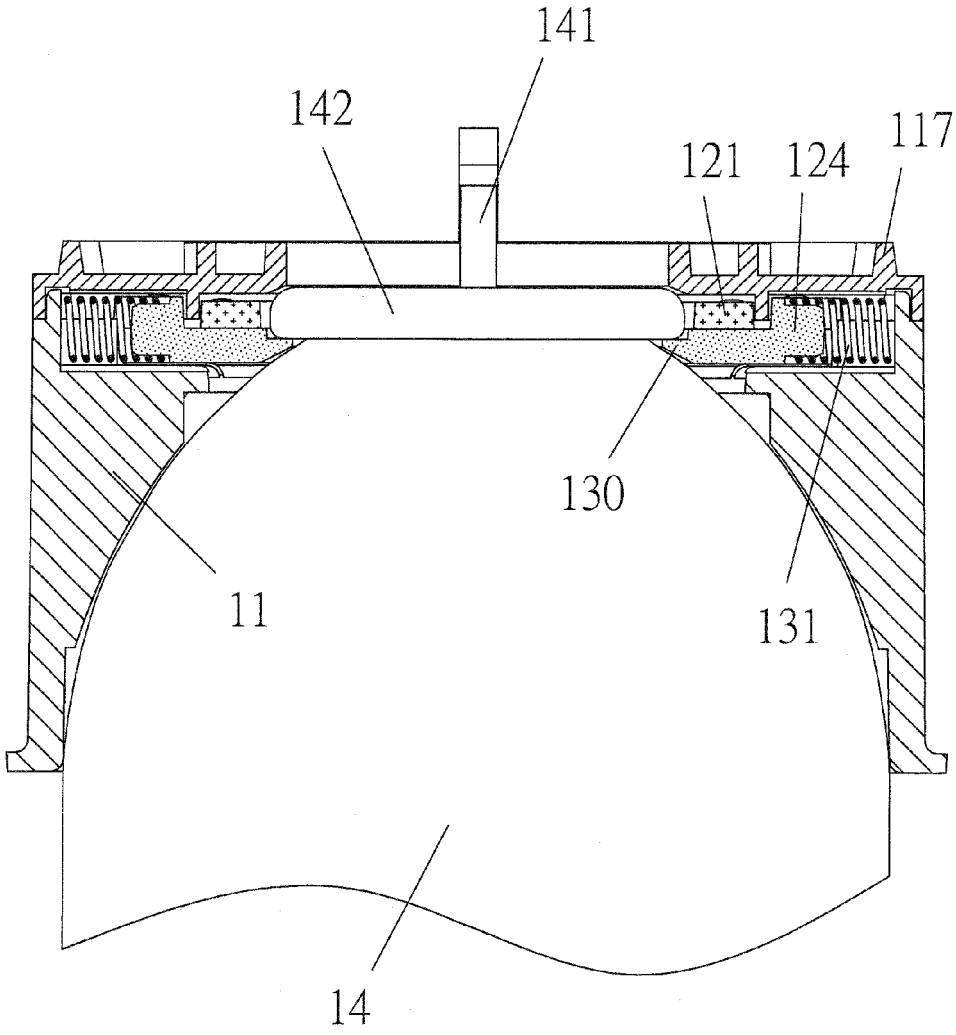
FIG. 7 is a sectional view of the embodiment, which has mounted a canister.

As shown in FIGS. 6 and 7, when mounting a canister 14, a user may press the pusher 122 to allow the generally V-shaped protrusion 123 to push the sloping surfaces 127, 128 to move the two arched piece 124 outwardly so that the canister 14 can be fitted in the housing 11 from the bottom. Thereafter, the user may release the pusher 122 to allow the springs 131 to restore to their original positions so that the sharp edges 130 of the arched pieces 124 can clamp a neck 142 of the canister 14 so that the canister 14 can be mounted quickly and properly. Similarly, the canister 14 can be quickly dismounted in the same manner.

Accordingly, the present invention has the following advantages over the prior art.

1. An exhausted canister can be quickly and conveniently dismounted by pressing a pusher 122 of the present invention to allow the sharp edges 130 of the two arched pieces 24 to clear of the neck 124 of the canister so as to release the canister.

2. A canister can be quickly and conveniently mounted without a need to see the clamping status of the canister in the mounting process.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A quick-mounting device for canisters comprising:

a housing defining a recess at a top thereof and a hollow space therein, said recess being defined by a circumferential surface and a bottom surface, said housing being sealed with a cover that defines a though hole at a center thereof; and an adjustment means including two arched pieces and a control piece, said arched pieces being placed in said recess of said housing to define an opening therebetween, said opening communicating with said through hole of said cover and said hollow space of said housing, said control piece having a pusher and being placed on top of said arched pieces to engage with two ends of each said arched piece, each said arched piece being provided with a spring at an external side thereof intermediate of the two ends to be elastically engaged with said housing; whereby said pusher of said control piece of said adjustment means can be pressed to have two said arched pieces moved outwardly so as to change the dimension of said opening defined by two said arched pieces.

2. A quick-mounting device for canisters as claimed in claim 1, wherein the circumferential surface of said recess of said housing is defined with a first pair of opposing recesses and a second pair of opposing recesses, the first pair of opposing recesses being located at an orientation about 90 degrees relative to the second pair of opposing recesses.

3. A quick-mounting device for canisters as claimed in claim 1, wherein said control piece is formed into a generally annular piece having two opposing projections, one of which is formed with the pusher, each said projection being provided with an engaging protrusion on a bottom surface thereof; and wherein each of the two ends of each said arched piece is formed with a sloping surface, each of said arched pieces is formed with two protrusions and a boss therebetween at an external side intermediate of the two ends for engaging with a corresponding spring.

4. A quick-mounting device for canisters as claimed in claim 3, wherein each said engaging protrusion of said control piece of said adjustment means has two sides formed into a general V-shape for mating with two corresponding sloping surfaces respectively on two said arched pieces.

5. A quick-mounting device for canisters as claimed in claim 1, wherein each said arched pieces of said adjustment means is formed with a sharp edge along an internal side thereof.

6. A quick-mounting device for canisters as claimed in claim 1, wherein the bottom surface of said recess of said housing is defined with multiple grooves to be inserted with protrusions which are formed on bottom surfaces of said arched pieces.

7. A quick-mounting device for canisters as claimed in claim 1, wherein said housing defines a plurality of first holes on a top thereof, and said cover defines a plurality of second holes corresponding to said first holes, so that said cover can be sealed with said housing by using fastening members through said first and second holes.

8. A quick-mounting device for canisters as claimed in claim 1, wherein two opposing lugs are provided on said cover across said through hole of said cover.

* * * * *